United States Patent [19]

Ide et al.

[11] Patent Number: 5,053,196

[45] Date of Patent: Oct. 1, 1991

[54] METHOD FOR CONTAINER CONVEYANCE IN GERM-FREE FILLING/PACKAGING SYSTEM

[75] Inventors: Takeo Ide, Kawagoe; Koichi Hatanaka, Sayama, both of Japan

[73] Assignee: Snow Brand Milk Products Co., Ltd., Hokkaido, Japan

[21] Appl. No.: 382,201

[22] Filed: Jul. 19, 1989

[30] Foreign Application Priority Data

Jul. 26, 1988 [JP] Japan ..... 63-186448
Jul. 26, 1988 [JP] Japan ..... 63-186449

[51] Int. Cl.[5] ..... A61L 2/00; B65B 55/02

[52] U.S. Cl. ..... 422/28; 422/30; 422/297; 422/298; 422/302; 422/304; 422/300; 53/425; 53/426; 53/167; 426/399; 426/401; 426/407

[58] Field of Search ..... 422/28, 30, 297, 298, 422/302, 304; 53/425, 426, 167; 426/399, 401, 407

[56] References Cited

U.S. PATENT DOCUMENTS

| | | | |
|---|---|---|---|
| 2,268,563 | 4/1938 | Ball | 426/407 |
| 2,575,863 | 3/1948 | Clifcorn | 426/399 |
| 4,424,189 | 1/1984 | Hick | 422/28 |
| 4,707,334 | 11/1987 | Gerhard | 426/399 |
| 4,803,055 | 2/1989 | Ueda | 422/300 |

OTHER PUBLICATIONS

Kelsey, "Aseptic-Packaging-Machine Design".

*Primary Examiner*—Robert J. Warden
*Assistant Examiner*—Theresa A. Trembley
*Attorney, Agent, or Firm*—Griffin Branigan & Butler

[57] ABSTRACT

A rotatable partition is provided to establish a sealing relationship between each pair of successive processes in a germ-free filling/packaging system or between a said processes and the outer air and a hollow cylinder containing therein this rotatable partition is provided with an inlet through which germ-free gas flows in and an outlet through which germ-free gas flows out. Floor(s) of a germicide mist fixing station and/or a germicide removing station, and/or conveyor arms is (are) provided heater elements.

7 Claims, 13 Drawing Sheets

METHOD FOR CONTAINER CONVEYANCE IN GERM-FREE FILLING/PACKAGING SYSTEM

BACKGROUND OF THE INVENTION

The present invention relates to a germ-free filling-/packaging system adapted to sterilize containers and then to fill these containers with germ-free food or drink, i.e. a method and apparatus. Between each pair of successive processes or within each process, the method and apparatus convey containers and simultaneously achieve adequate sterilization thereof, while maintaining a sealed condition within each process or betwen processes.

It is well known from Japanese Patent publication Nos. 1980-3218 1980-4618 to perform sterilization, filling and sealing of the containers within a germ-free chamber while conveying these containers. According to said Patent Publication No. 1980-3278, the germ-free chamber is maintained at a pressure slightly higher than that of the outer air and thereby the outer air is prevented from entering thereinto.

However, it is difficult to constantly maintain the inner pressure of the germ-free chamber at such a high level and, once the inner pressure has dropped, it is impossible to convey a succeeding container into the germ-free chamber. Thus this system of prior art is disadvantageous in that continuous processes can not be carried out.

Said Patent Publication No. 1980-4618 discloses a system adapted to establish a sealing relationship between the germ-free chamber and the outer air by utilizing liquid. However, there is no provision to convey the containers into and within the germ-free chamber, or to convey the containers out of the germ-free chamber after being filled with food or drink, or to maintain the condition of the germ-free chamber.

The inventor of the present application has disclosed a countermeasure to solve these problems in Japanese Disclosure Gazette No. 1986-203322.

This solution is to provide rotatable partitions adapted for sealing the respective processes from the outer air and the containers are conveyed by recesses formed in these rotatable partitions for this purpose. Accordingly, such solution is certainly advantageous in that the respective processes are always isolated from the outer air and the outer air is prevented from directly flowing into the respective processes. However, this system of prior art utilizing the rotatable partitions has been found to be inadequate in the sealing effect against the outer air. Specifically, germicide in the sterilizing process is apt to leak out and into the outer air and thereby injure an operator's health. Also, germs in the outer air sometimes enter into the respective process, destroying the germ-free condition maintained therein.

Additionally, according to the inventor's Japanese Disclosure Gazette No. 1986-203322, $H_2O_2$ mist which has been used in the sterilizing chamber for sterilization is then dried in a drying chamber by hot air. However, $H_2O_2$ mist is apt to cling to the conveyor means in the sterilizing chamber and, therefore, an operation for removing this is required. Further-more, sometimes $H_2O_2$ mist is condensed and accumulated on the conveyor means. In such case, droplets of germicide cling to the containers also and an operation for removing said droplets is required.

Also in the drying chamber, the individual containers come into contact with the same locations of this chamber, so germicide is apt to be condensed on these locations. As a consequence, the drying chamber can not provide the expected function, sometimes leaving a certain quantity of germicide still not dried.

Moreover, when conveyor arms are used as the conveyor means in the drying chamber, these conveyor arms intercept hot air streams and thereby obstruct effective drying.

SUMMARY OF THE INVENTION

In view of the problems as have been mentioned above, an object of the present invention is to provide, when the containers are conveyed by rotation of the rotatable partitions disposed between the successive processes of germ-free filling, a method and an apparatus for container conveyance adapted to ensure that the atmosphere in the proceeding process and the atmosphere in a following process are isolated from each other by the rotatable partition.

The object as set forth above is achieved, in accordance with the present invention, by a method for conveyance of containers in a germ-free filling/packaging system having rotatable partitions disposed between successive processes such as sterilizing or germ-free processes or between respective processes and the outer air in order to seal the atmosphere in the respective processes, said method being characterized by that the containers received in respective container transporting recesses formed in each of said rotatable partitions are conveyed successively from one process to the next process as said rotatable partition rotates and simultaneously interior of said container transporting recesses is exposed to germicide containing gas or germ-free gas to make said interior of said container transporting recesses germ-free.

Such method for container conveyance in the germ-free filling/packaging system is performed, according to the present invention, by an apparatus for container conveyance comprising an air-tight cylinder having two openings and disposed between each pair of successive processes such as sterilizing or germ-free processes of the germ-free filling/packaging system or between each of these processes and outer air; a rotatable partition rotatably mounted within said cylinder; recesses formed in said rotatable partition to convey the respective containers from the one to the other of said two openings; and inlet and outlet formed in said air-tight cylinder for gas flow to remove germicide from said recesses or to sterilize these recesses.

The method and apparatus of the present invention for container conveyance in the germ-free filling/packaging system as has been mentioned above provide the following affects;

The respective container transporting recesses are maintained in a germ-free and dried condition during their movement between each pair of successive processes or between each process and the outer air and there occurs no leakage of the atmosphere from the respective processes into the exterior. In addition, leakage of germicide to the exterior is also avoided and condensation of germicide mist either on the rotatable partition or on the containers is effectively eliminated. Accordingly, the containers can be handled in a highly hygienic manner without any deterioration of product. Furthermore, no injure of an operator's health due to germicide leakage may occur and thus desired safety is assured.

Another object of the present invention is to protect the containers against contamination due to germicide accumulation or germicide left clinging thereto which might otherwise occur during conveyance of these containers in the germicide fixing station or the germicide removing station of a germ-free filling/packaging system.

This object is achieved, in accordance with the present invention, by a method for conveyance of containers in a germ-free filling/packaging system having a germicide mist fixing station for sterilization of the containers and a germicide removing station for drying of germicide clinging to the containers, said method being characterized by that, in said germicide mist fixing station and said germicide removing station, the containers are held by respective comb-teeth formed in respective conveyor arms and thereby conveyed to subsequent processes, respectively, and, during such conveyance of the containers, at least one of floor(s) of said germicide mist fixing station and/or said germicide removing station and said comb-teeth of each conveyor arm are heated so as to prevent germicide from being condensed on areas along which the containers come into contact with said floor(s) or comb-teeth.

This method for container conveyance in the germ-free filling/packaging system is performed by using an apparatus for container conveyance being characterized by that at least one of floor(s) of said germicide mist fixing station and/or said germicide removing station and said conveyor arm is provided with a heater adapted to heat and dry the areas along which the containers come into contact with said floor(s) or said conveyor arm.

The method and apparatus for container conveyance in the germ-free filling/packaging system as has been mentioned just above provide the following affects.

In the mist fixing station, germicide clinging to the conveyor arm and the container carrying floor can be effectively evaporated to avoid inconveniences which might otherwise be encountered, e.g., condensation of germicide mist on the containers, droplets of germicide accumulated on the floor of the mist fixing station and corrosion of the equipment components due to such germicide droplets.

Also in the germicide removing station, sufficient heating is assured even in the areas along which the containers come into contact with the conveyor arm and the container carrying floor, and thereby drying is sufficiently done to eliminate any remaining undried quantity of germicide.

In this way, the container conveyance is performed in a highly hygienic manner without any deterioration of food or drink due to residual germicide.

Another object of the present invention is to ensure that the atmosphere in a preceding process and the atmosphere in a following process are isolated from each other by the above mentioned rotatable partition, while avoiding contamination of the containers with residual germicide in the germicide mist fixing station and the germicide removing station.

This object is achieved, according to the present invention, by a combination of the previously mentioned container conveyor in the germ-free filling-/packaging system provided in association with said rotatable partition and the last-mentioned container conveyor including the heater means associated with said germicide mist fixing station and said germicide removing station.

More specifically, this object is achieved by an apparatus for container conveyance in the germ-free filling and packaging system, said apparatus comprising an air-tight cylinder having two openings and disposed between each pair of successive processes of the germ-free filling/packaging system or between one of these processes and outer air; a rotatable partition rotatably mounted within said cylinder; recesses formed in said rotatable partition to transport the respective containers from the one to the other of said two openings; inlet and outlet formed in said air-tight cylinder for gas flow to remove germicide from said recesses or to sterilize these recesses; and heater elements carried by at least one of floor(s) of a germicide mist fixing station and/or a germicide removing station and conveyor arms associated with these stations to heat and dry areas along which the containers come into contact with said floor(s) or said conveyor arms.

BRIEF DESCRIPTION OF THE DRAWINGS

The above and other objects of the present invention will be seen by reference to the description taken in connection with the accompanying drawings, in which.

DETAILED DESCRIPTION OF THE INVENTION

Figure 1:
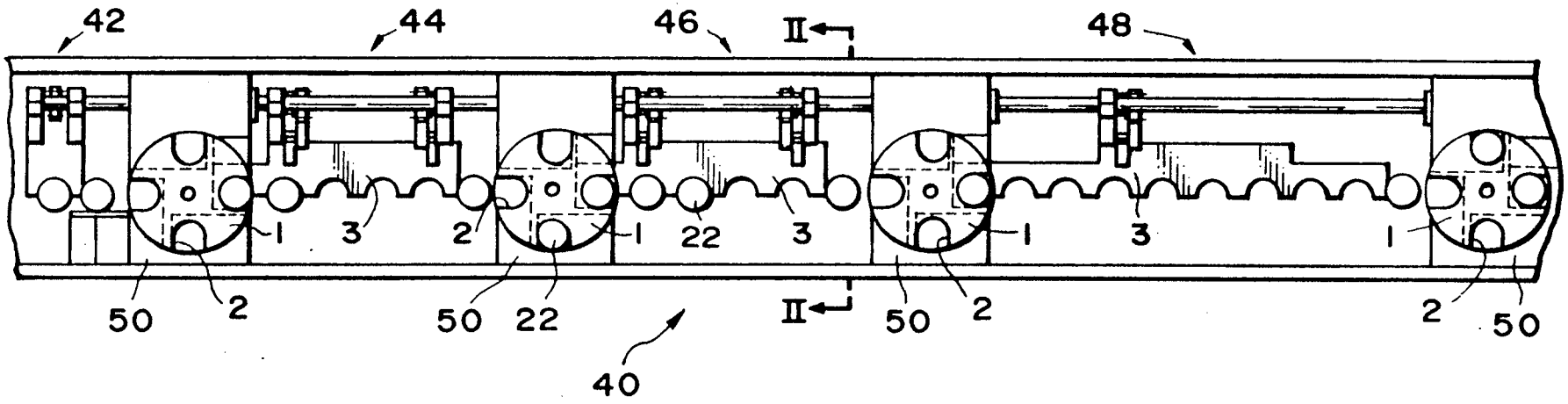
FIG. 1A is a plan view showing a germ-free filling system according to the present invention.
FIG. 1B is a plan view of a block 50 shown in FIG. 1A.
Figure 1:
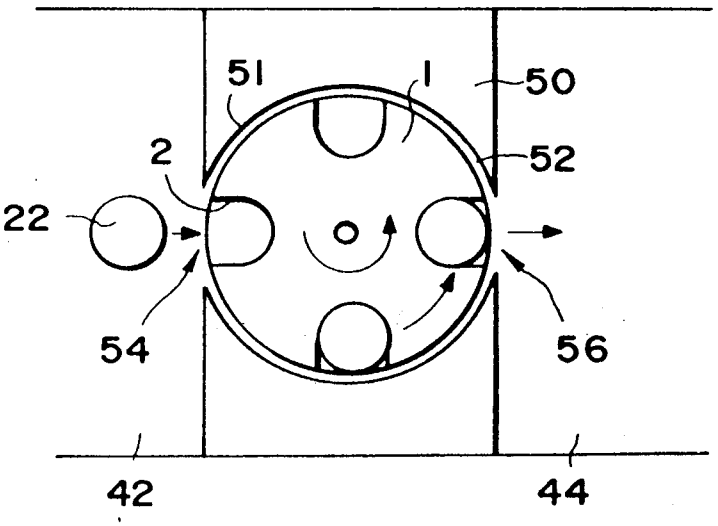

The germ-free filling/packaging system of the present invention will be described in reference with FIG. 1. Said germ-free filling/packaging system 40 comprises a container supply station 42, a germicide mist fixing station 44 serving to sterilize the containers, a germicide removing station 46 serving also as a drying chamber, and a filling/sealing station 48 providing for germ-free filling of food or drink.

Blocks 50 are respectively provided between the container supply station 42 and the germicide mist fixing station 44, between said germicide mist fixing station 44 and the germicide removing station 46, between said germicide removing station 46 and the container filling-/sealing station 48, and at outlet of said container filling-/sealing station 48.

The block 50 at the outlet of the container filling-/sealing station 48 may be replaced by means to regulate a pressure within said container filling/sealing station 48 at a level which is a positive with respect to the atmospheric pressure or means to breathe germ-free air out and thereby to achieve air-tightness.

As seen in FIG. 1B, each of the blocks 50 defines a cylindrical space 52 having two openings 54, 56 respectively formed at front and rear sides thereof. A rotatable partition 1 is provided within said cylindrical space 52. Said rotatable partition 1 includes four container transporting recesses 2 formed therein at angular intervals of 90 degrees so that the individual containers may be received and discharged by the respective container transporting recesses 2. Accordingly, the rotatable partitions 1 are intermittently rotated by ¼ revolution within the respective cylindrical spaces 52 to seal the respective blocks 50 interposed between the respective process.

There are provided between each pair of the adjacent rotatable partitions a comb-toothed conveyor arm 3 adapted for so-called box-motion and a guide rail 20 operatively associated with said conveyor arm 3 so that the germ-free packaging container 22 is held between a comb-tooth of said conveyor arm 3 and said guide rail 20 and thus conveyed.

Figure 3:
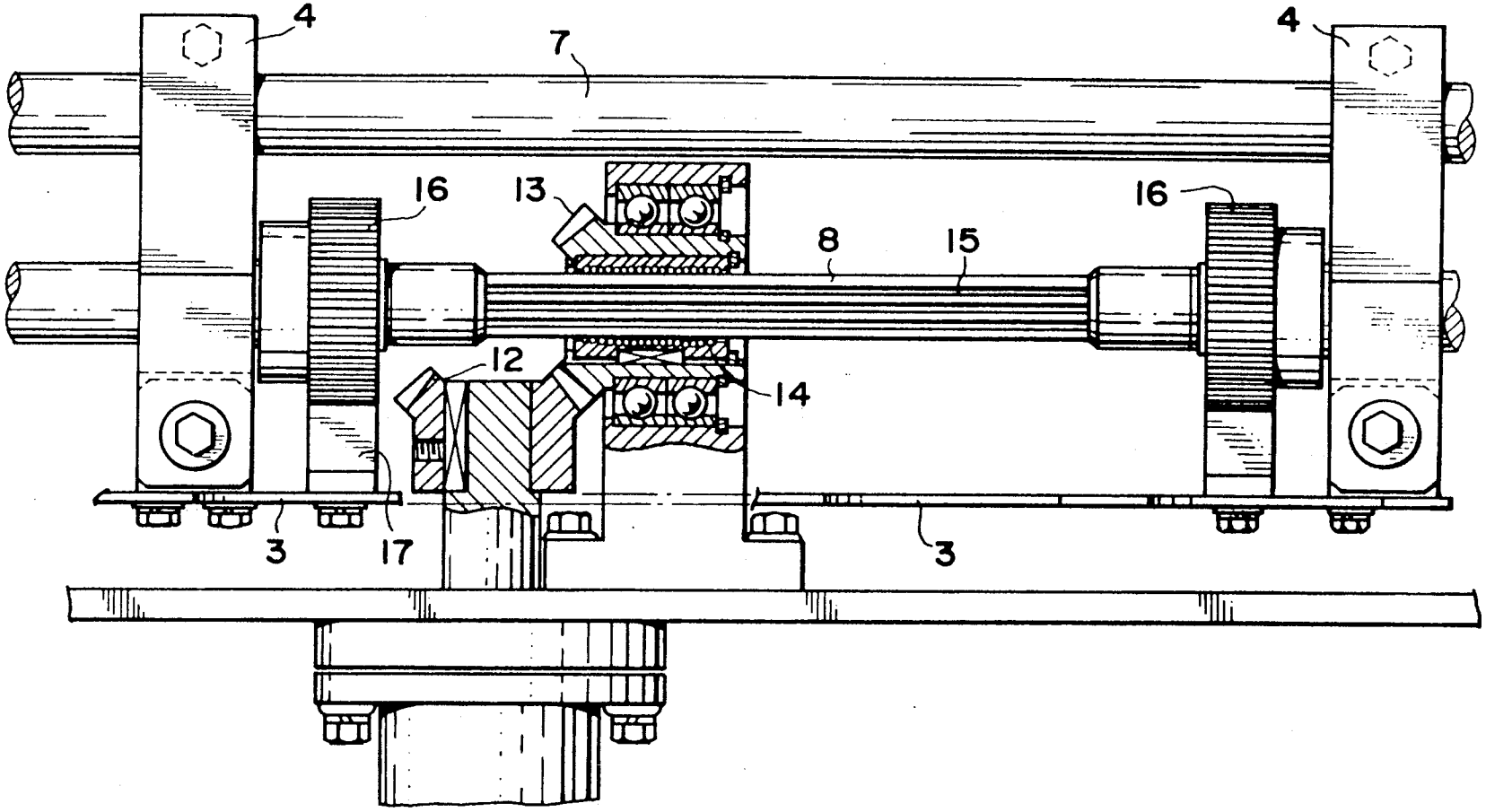
FIG. 3A is a front view showing, partially in a section, a mechanism adapted to drive a conveyor arm back and forth.
FIG. 3B is a left side view corresponding to FIG. 3A.
Figure 3:
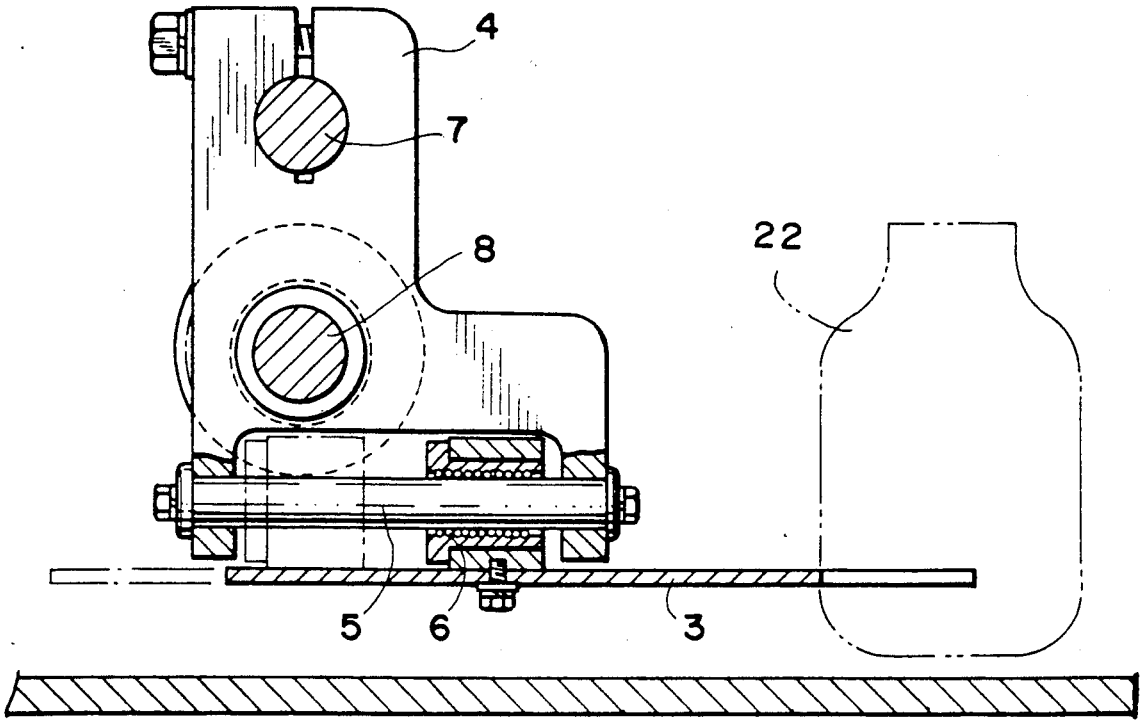

Now said box-motion of the conveyor arm 3 indicated by arrows in FIG. 4 will be discussed, and, first, the mechanism for driving the conveyor arm 3 back and forth will be considered. As shown by FIG. 3B, the conveyor arm 3 is supported by a ball bearing 6 back and forth slidably with respect to a shaft 5 of bearing brackets 4. As seen in FIG. 3A, a drive force provided from a drive mechanism not shown is transmitted through bevel gears 12, 13 to a ball bearing 14 carried by said bevel gear 13, which ball bearing 14, in turn, rotates a shaft 8 by engagement with splines 15 formed around said shaft 8. Rotation of this shaft 8 causes a pinion 16 mounted on said shaft 8 to be rotated and thereby a rack 17 mounted on the conveyor arm 3 adapted to be engaged with said pinion 16 drives the conveyor arm 3 back and forth.

It should be understood that the shaft 8 is movable also laterally as the bearing brackets 4 are laterally moved, because of the above mentioned arrangement such that the bevel gear 13 is provided with the ball bearing 14 and the shaft 8 is provided with the splines 15.

Figure 5:
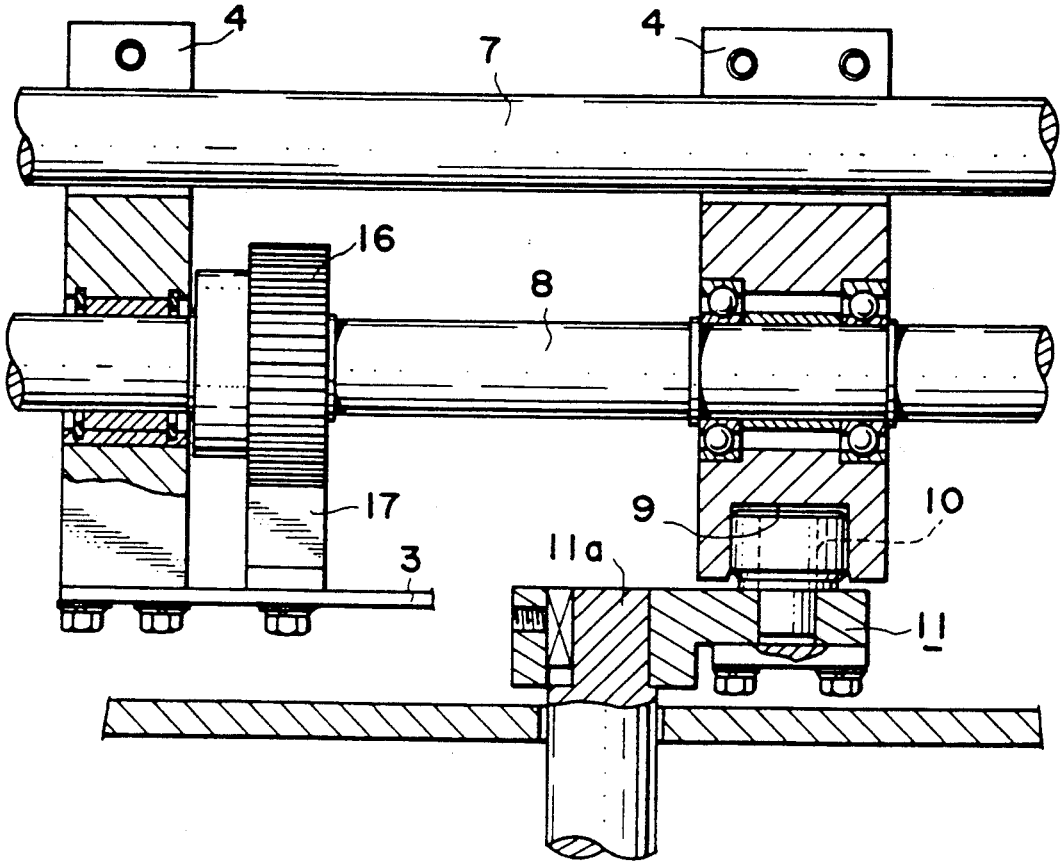
FIG. 5A is a front view showing, partially in a section, a mechanism adapted for laterally driving the conveyor arm.
FIG. 5B is a right side view, partially in a section, similar to FIG. 5A.
Figure 5B:
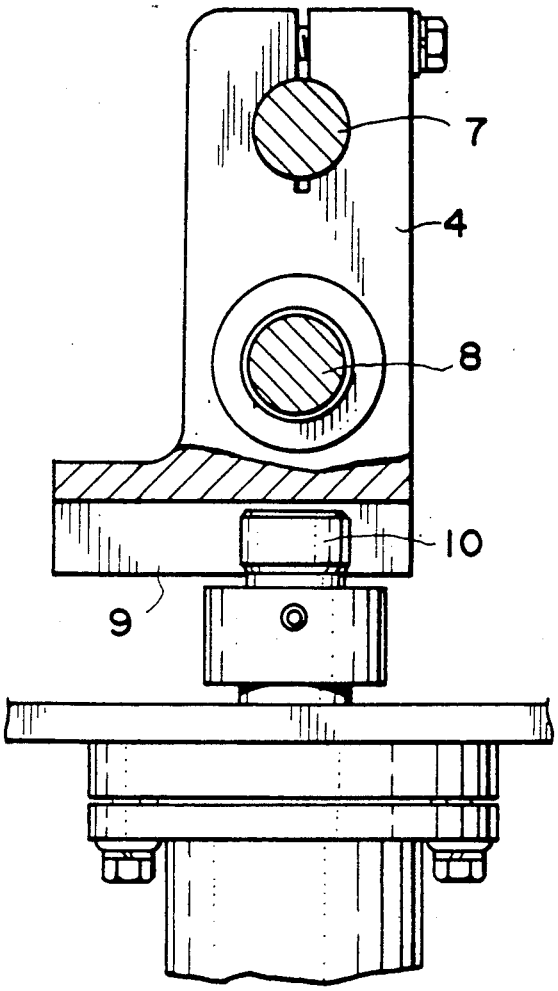

Then the mechanism to drive the conveyor arm 3 laterally will be considered in reference with FIGS. 5A and 5B.

The bearing brackets 4 are laterally movable along a rail 7 and the rotatable shaft 8 rotatably extends through said bearing brackets 4. It should be noted here that the rotatable shaft 8 is provided with suitable stopper means allowing said shaft 8 to be laterally moved integrally with said brackets 4.

The bearing brackets 4 are respectively provided in respective bottoms thereof with grooves 9 in which the associated rollers 10 are movably received. Each of said rollers 10 is mounted on a rotatable arm 11 at an end remote from a shaft 11*a* associated with said rotatable arm 11. Rotation of this arm 11 causes the roller 10 to move along said groove 9, thereby causes the bearing brackets 4 to be laterally moved and thereby causes the conveyor arm 3 also to be laterally moved.

Figure 4:
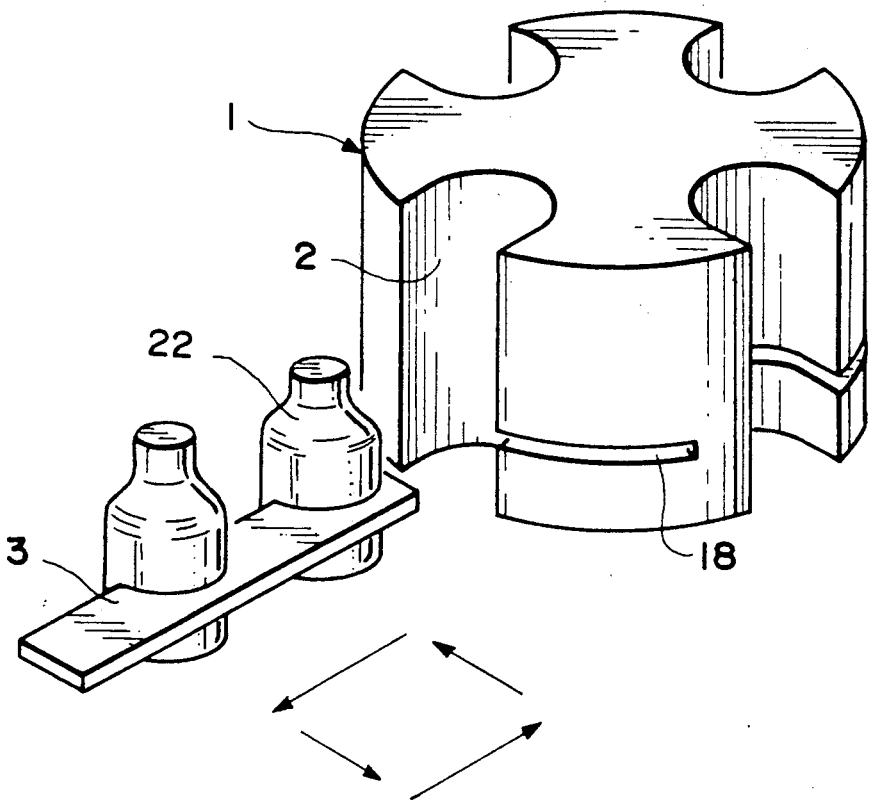
FIG. 4 is a perspective view illustrating a relationship of a rotatable partition with the conveyor arm.

Said back and forth movement and lateral movement of the conveyor arm 3 may be combined to provide a box-motion of the conveyor arm 3 as indicated by arrows in FIG. 4.

More specifically, the conveyor arm 3 moves forward into engagement with the container to convey it, and moves backward, after a conveyance has been done over a predetermined distance, to its home position. Such motion is repeated.

As shown by FIG. 4, each of the container transporting recesses 2 is provided in its side wall with a horizontal slit 18 so that the conveyor arm 3 may partially enter into this recess 2 along said slit 18 to deliver the container into this recess 2 and simultaneously to seal upper and lower portions of this recess 2 from the outer air, thus preventing air leakage.

Figure 2:
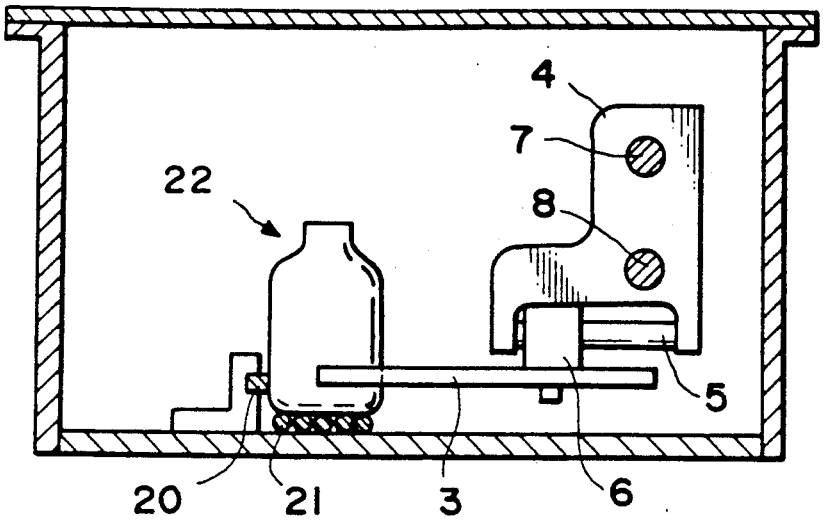
FIG. 2 is a sectional view taken along a line II—II in FIG. 1A.

Referring to FIG. 2, reference numeral 20 designates a guide rail for a rear side of the container and reference numeral 21 designates a frame surface on which the container is slidably moved.

One aspect of the present invention relates to germ-free conveyor means provided in the respective blocks 50 which are, in turn, interposed between the successive processes in the above mentioned germ-free filling-/packaging system. Said germ-free conveyor means may be constructed so that germicide once fixed to the respective container transporting recesses 2 is removed by germ-free gas during intermittent travels of said container transporting recesses 2 as each rotatable partition 1 is intermittently rotated or so that said container transporting recesses 2 are effectively made germ-free by using germicide containing air stream or germ-free gas stream.

Figure 6A:
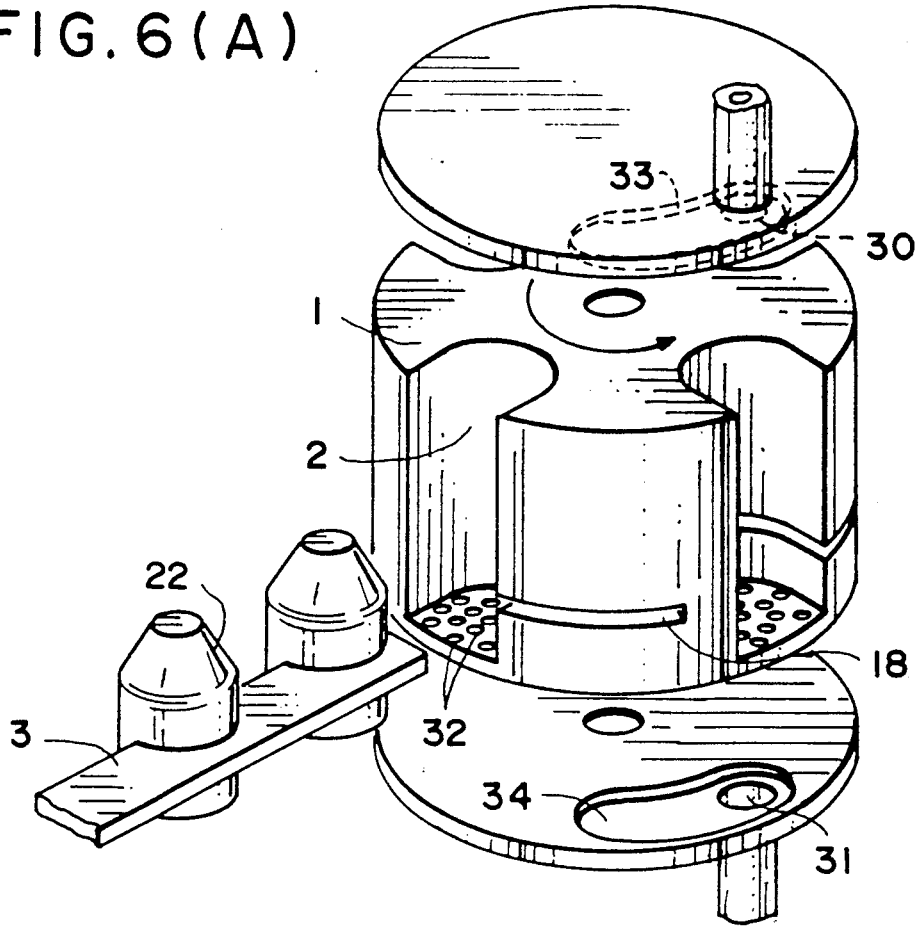
FIG. 6A is a perspective view showing the first embodiment of the germ-free conveyor means in the block 50.
Figure 6B:
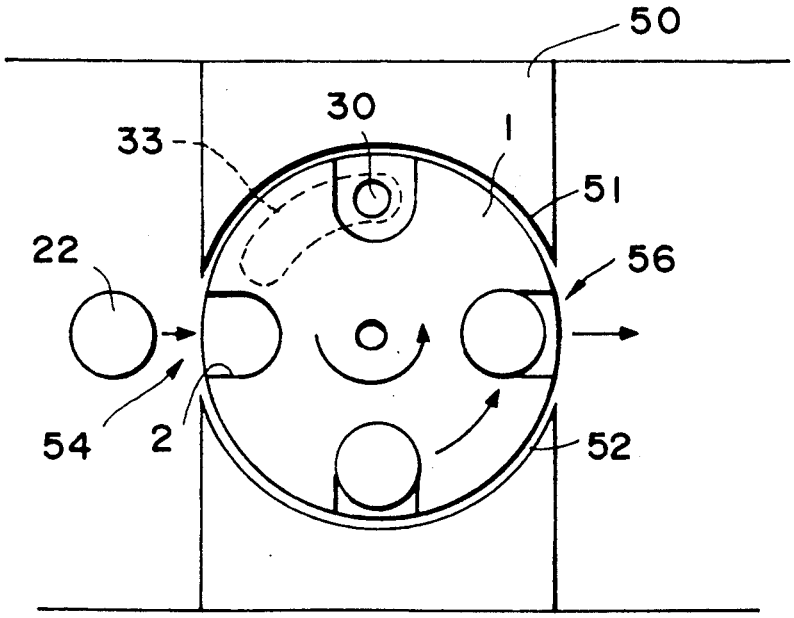
FIG. 6B is a plan view corresponding to FIG. 6A.

FIGS. 6A and 6B show the first embodiment of the germ-free conveyor means in which the cylindrical space 52 is provided in its top with a gas inlet 30 and in its bottom with a gas outlet 31. It should be understood that a space surrounded by a cylindrical wall 51 is meant by the term "cylindrical space 52".

Bottom wall of the container transporting recess 2 is provided with a plurality of perforations 32 through which germ-free, gas, e.g. aspect gas, supplied from above may flow out from recess 2. Circumferential elongate chambers 33, 34 are formed around the gas inlet 30 and the gas outlet 31, respectively, so that these chambers 33, 34 may be opposed to each other with interposition of said perforations 32 as the rotatable partition 1 rotates. perforations 32 as the rotatable partition 1 rotates.

As has already been explained, the respective rotatable partitions 1 are intermittenly rotated by ¼ revolution for each cycle while maintaining the sealing relationship between the successive processes and the respective container transporting recesses 2 spaced by 90 degrees from one another in each rotatable partition 1 and successively supplied from the gas inlet 30 with germ-free gas.

Germ-free gas may be gas containing therein germicide, for example, $H_2O_2$ or hot air approximately at a temperature of 100° C.

The present embodiment includes the chambers 33, 34 formed around the gas inlet and outlet, respectively, adapted to facilitate flowing of germ-free gas through the respective container transporting recesses 2 as the rotatable partition 1 rotates and is advantageous in that each recess 2 can be exposed to such gas flow for a time as long as possible.

In this manner, each recess 2 is adequately exposed to said germ-free gas while this recess 2 travels from the one opening 54 to the diametrically opposed opening 56, passing between the chamber 33 formed in fluid communication with the gas inlet 30 and the chamber 34 formed in fluid communication with the gas outlet 31, as the rotatable partition 1 rotates, and thereby the interior of this recess 2 is brought into a germ-free or dried condition. Making the container transporting recesses 2 germ-free contributes to prevent the germ-free condition of the subsequent process from being adversely affected by the preceding process. And making the container transporting recesses 2 well dried contributes to avoid leakage of germicide into the subsequent process or into the outer air.

Figure 7A:
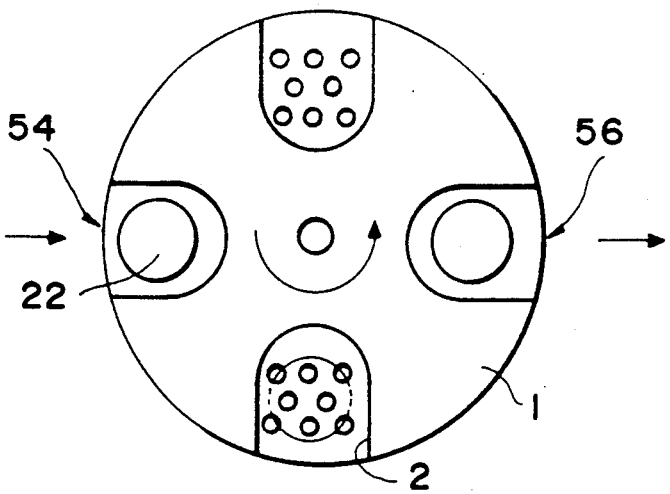
FIG. 7A is a perspective view showing the second embodiment of the germ-free conveyor means in the block 50.
Figure 7B:
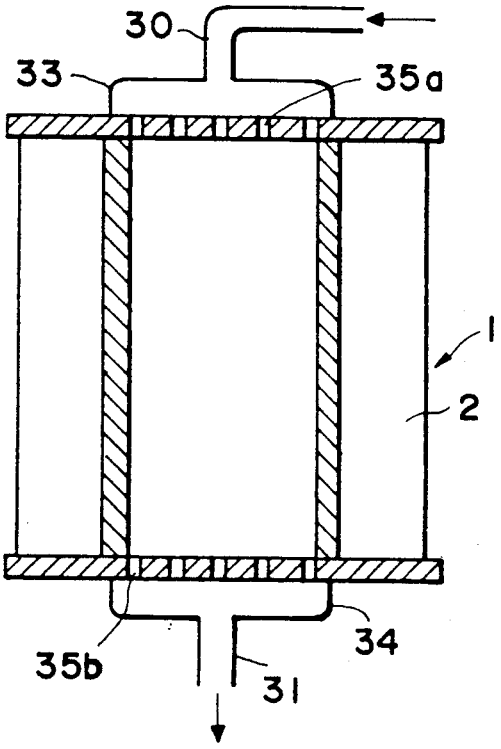
FIG. 7B is a sectional view corresponding to FIG. 7A.
Figure 7C:
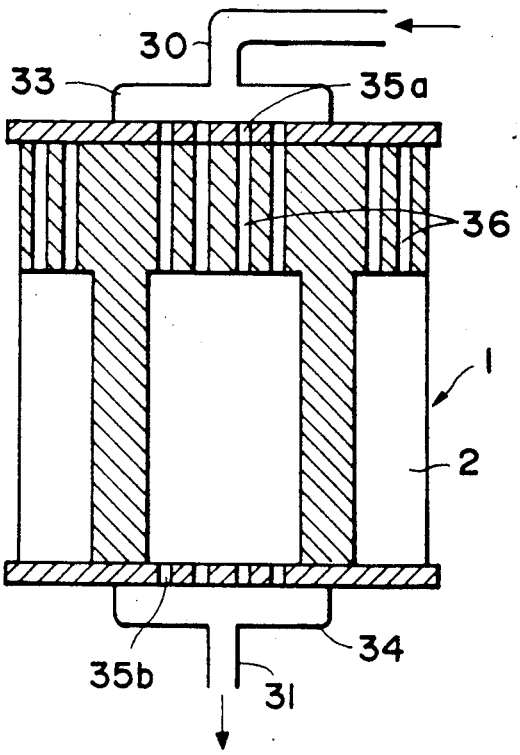
FIG. 7C is a sectional view showing a variation of the embodiment shown by FIG. 7A.

FIGS. 7A, 7B and 7C illustrates other embodiments of the germ-free conveyor in the respective blocks 50. According to these embodiments, the respective container transporting recesses 2 are supplied with germ-free gas at an intermediate position in the travel course of the container 22 from the opening 54 serving to receive the container 22 to the diametrically opposite opening 56 serving to discharge the container 22 and another intermediate position in the travel course of the container 22 from said opening 56 to said opening 54. FIG. 7B illustrates an embodiment in which a disc provided with perforations 35*a* is mounted under the chamber 33 which is formed in fluid communicating relationship with the gas inlet 30 and a similar disc having perforations 35*b* is placed above the chamber 34 formed in fluid communicating relationship with the gas outlet 31 so that a germ-free gas can directly flow into the respective container transporating recesses 2.

FIG. 7C illustrates an embodiment similar to that shown by FIG. 7B except that the container transporting recesses 2 are formed in a lower portion of the rotatable partition 1 and, to supply germ-free gas through the disc perforations 35*a* into the respective recesses 2, the rotatable partition 1 itself is provided with perforations 36 adapted to be aligned with said disc perforations 35*a*.

Figure 8A:
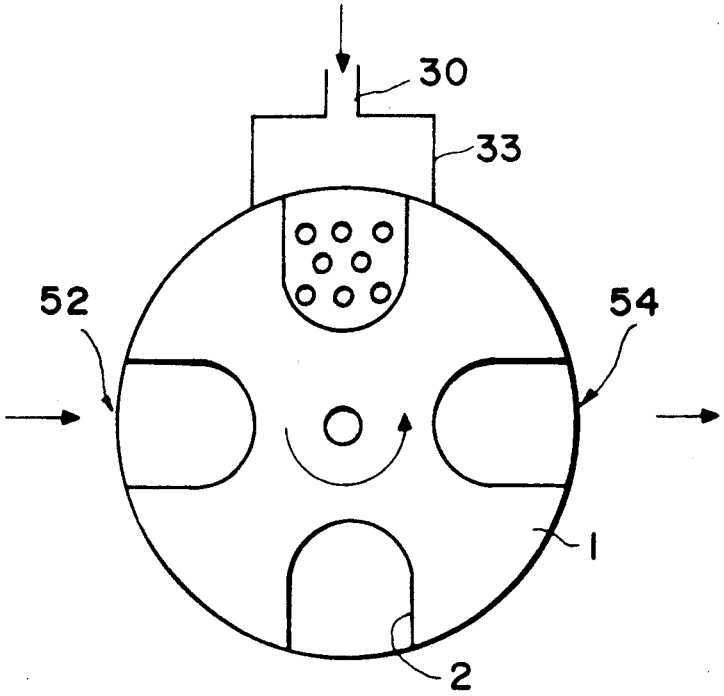
FIG. 8A is a perspective view showing the third embodiment of the germ-free conveyor means in the block 50.
Figure 8B:
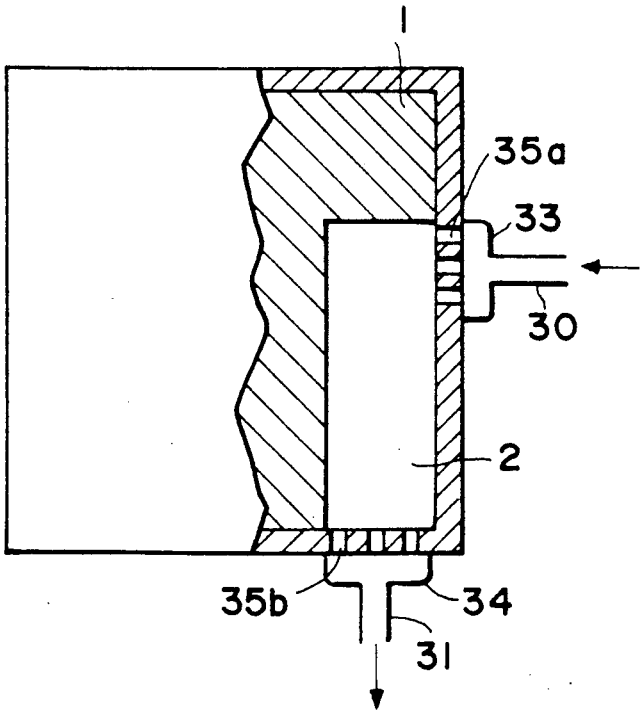
FIG. 8B is a perspective view showing, partially in a section, the germ-free conveyor means of FIG. 8A.

FIGS. 8A and 8B illustrate another further embodiment of the germ-free conveyor means for each block 50, in which the gas inlet 30 and the associated chamber 33 are provided laterally of the rotatable partition 1 and a cylindrical wall 51 surrounding the cylindrical space in each block 50 is partially formed with perforations 35*a* through which germ-free gas flows from the chamber 33 into the respective container transporting recesses 2.

Figure 9A:
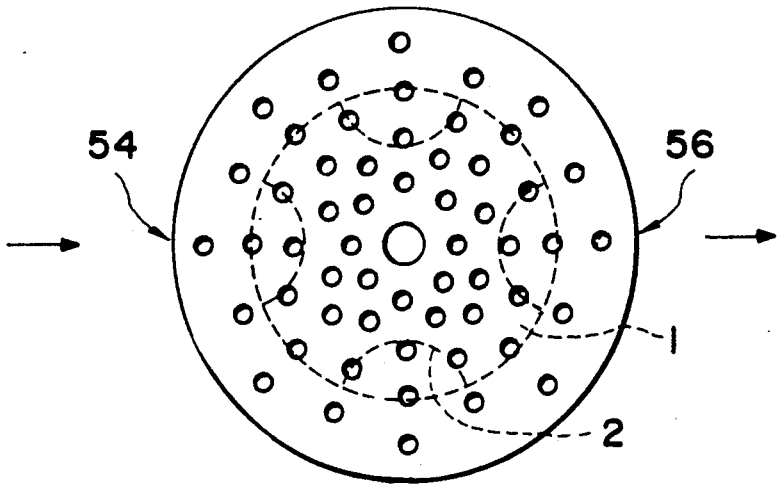
FIG. 9A is a plan view showing the fourth embodiment of the germ-free conveyor means in the block 50.
Figure 9B:
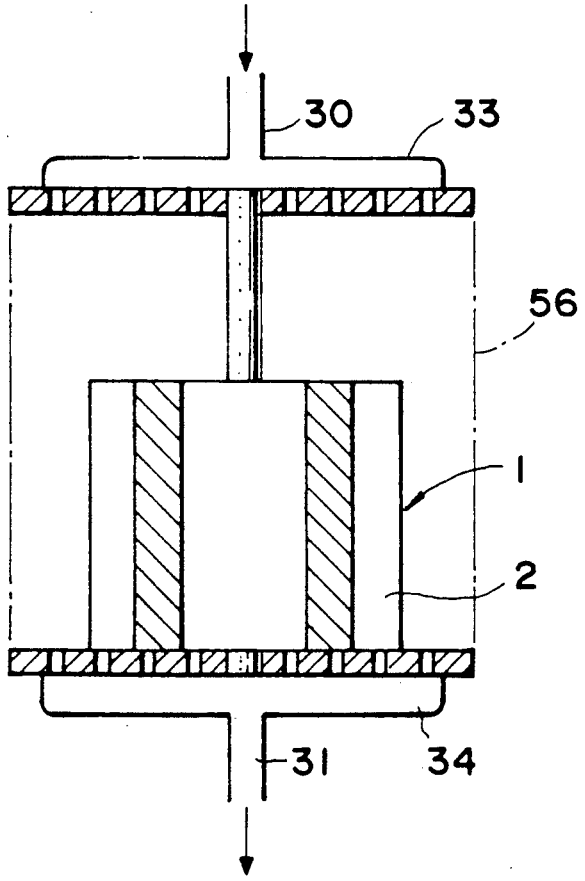
FIG. 9B is a sectional view corresponding to FIG. 9A.

FIGS. 9A and 9B illustrates still another embodiment of the germ-free conveyor means characterized by that germ-free gas can flow into the respective container transporting recesses 2 through apertures disposed over the entire top of cylinder spaces and flow out from said recesses 2 through apertures disposed over the entire bottom of cylindrical space 52. In this way, the respective containers are continuously exposed to germ-free gas as long as the containers 22 exist within the germ-free conveyor means.

In this embodiment, a relatively wide cylindrical space 52 is defined between the rotatable partition 1 and the cylindrical wall 51 surrounding the latter, and the respective container transporting recesses 2 are so configured to partitially carry the respective containers 22.

The respective embodiments of the germ-free conveyor means as have been mentioned hereinabove may be selectively disposed depending on the locations at which the rotatable partitions 1 are to be disposed.

For example, when it is desired to establish a sealing relationship between the outer air and the sterilizing process, the rotatable partition may be provided either only on the side of this process from which the germicide mist can leak into the outer air or only on the side from which the outer air can enter into this process. Of course, the germ-free conveyor means may be provided on both sides of such process. Also when it is necessary to assure a sealing relationship between the outer air and the process to be maintained germ-free, the germ-free conveyor means may be selectively disposed like the above mentioned case in which the sealing relationship must be established between the outer air and the sterilizing process.

It is not necessarily essential that the gas inlet 30 occupies an upper position and the gas outlet 31 occupies a lower position, namely, in the germ-free conveyor means used to intercept germicide mist, but it is preferred to dispose the gas inlet 30 above and to dispose the gas outlet 31 below, since germicide may partially form droplets around the gas outlet 31.

Provision of suction means in association with the gas outlet 31 is optional.

Another aspect of the present invention relates to germ-free conveyor means having heater elements in both the germicide mist fixing station and the germicide removing station.

This invention has a construction such that respective floors of the germicide mist fixing station 44, the germicide removing station 46, and the conveyor arms 3 are heated to avoid condensation of germicide which might otherwise occur in the areas where said floors and the comb-teeth of arm 3 come into contact with the containers 22.

Figure 10:
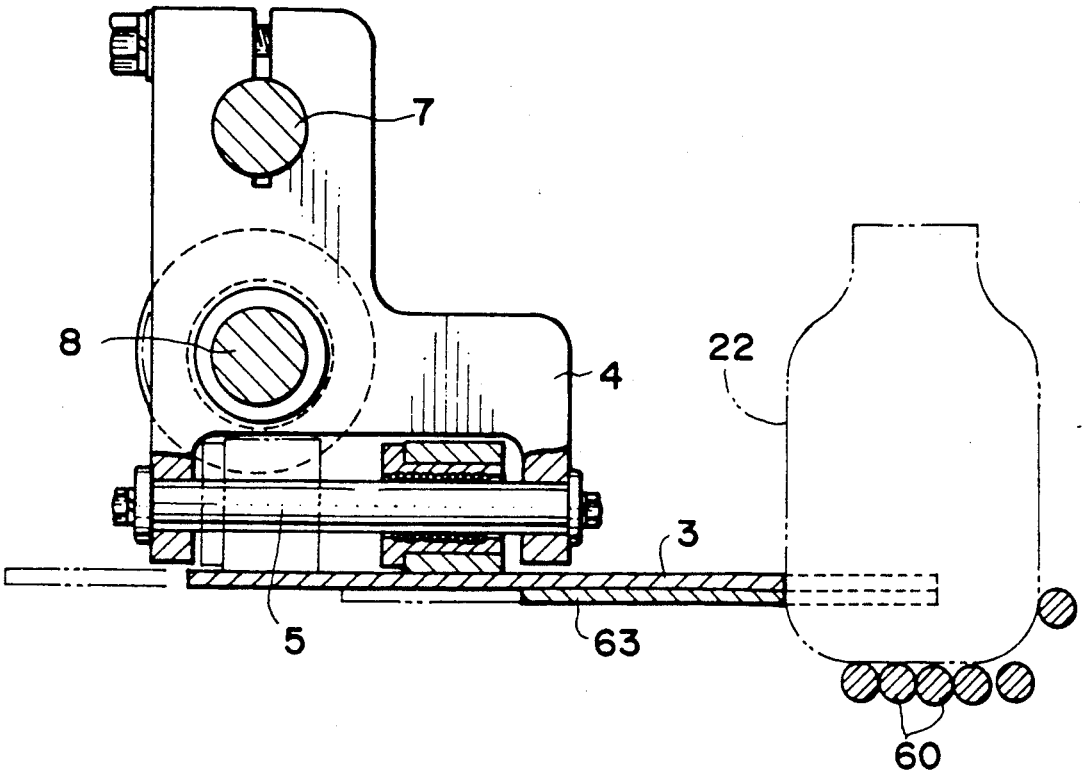
FIG. 10 is a side view illustrating a relationship of heat pipes 60 with the conveyor arm.

An embodiment of this invention will be described in reference with FIGS. 10 through 12. As shown, in the sterilizing processes, or germ-free processes the respective apparatus is provided on their bottoms with several heat pipes 60 extending along a direction in which the conveyor arms 3 having the comb-teeth perform their conveying function.

In this specific embodiment, the heater elements are provided so as to be held out of direct contact with the containers 22, in view of a fact that the containers are made of synthetic resin.

Figure 11:
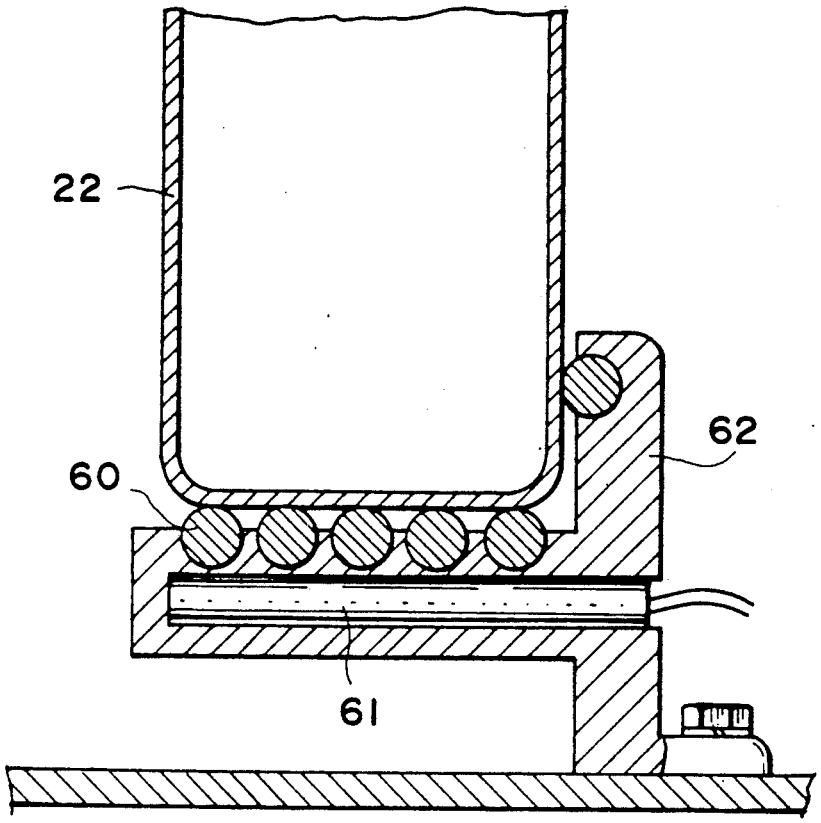
FIG. 11 is a sectional view showing an arrangement of an electric heater 61 disposed under the heat pipes 60.

Referring to FIG. 11, reference numeral 61 designates an electric heater, and heat generated as this electric heater 61 is energized is conducted through a heat pipe holder 62 to the heat pipes 60.

The heat pipes 60 may be made of suitable anticorrosive material such as SUS and heat medium flowing in the pipes may be alcohol or like. The heat pipe holder 62 may be made of material having a high heat conduction such as aluminum and may be heated to a temperature of 60° C. to 80° C. on the surface of each heat pipe 60.

Figure 12:
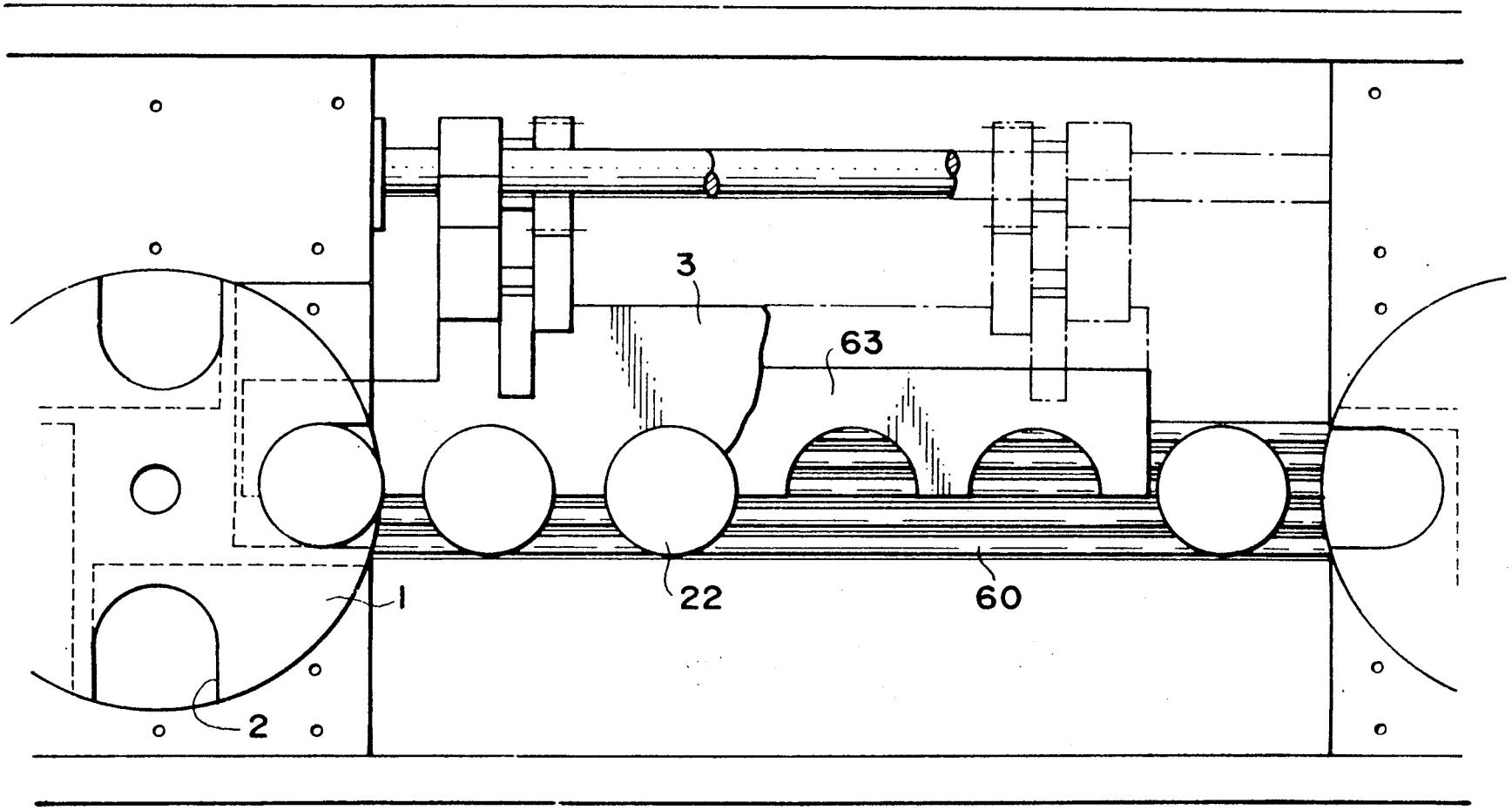
FIG. 12 is a plan view partially broken away, showing an arrangement of the electric heater applied to the underside of the conveyor arm 3.

As shown in FIG. 12, a flat electric heater 63 such as silicon rubber heater is applied to the underside of the comb-toothed conveyor arm 3 and thereby the conveyor arm 3 also is heated to a temperature of 60° C. to 80° C.

By heating the floors of the respective stations and the conveyor arms 3 in this manner, the condensed germicide mist (e.g., $H_2O_2$) on the areas where said components come into contact with the containers is rapidly dried and thereby said germicide mist is prevented from clinging to said areas.

The illustrated embodiment is advantageous also in that the area over which said floors come into contact with the containers 22 can be effectively reduced by said floors formed by said heat pipes and, in consequence, germicide mist can be distributed all over said floors.

While the invention has been particularly shown and described with reference to preferred embodiment thereof, it will be understood by those skilled in the art that the foregoing and other changes in form and details can be made therein without departing from the spirit and scope of the invention.

What is claimed is:

1. In a method for conveying containers through a germ-free filling/packaging process where the containers are conveyed through a series of steps in which a preceding step is separated from a succeeding step such as to substantially separate the atmosphere of the preceding step from the atmosphere of the succeeding step, the improvement comprising:

(1) contacting the containers and associated conveying apparatus with a germicidal gas, in a preceding germicidal step, sufficiently to sterilize said containers;

(2) conveying said sterilized containers to a rotatable partition separating a preceding step from a succeeding step, said partition having cylindrical side walls partly enclosed by a member having a container entrance opening and a container exit opening and which member is spaced from said partition sufficiently so as to provide a cylindrical space therebetween and wherein said side walls have a plurality of successive recesses therein of configurations to receive successively conveyed containers;

(3) moving successive sterilized containers into the successive recesses;

(4) rotating said partition such that a conveyed container in a conveying recess of said successive recesses is moved to a position between said entrance opening and said exit opening;

(5) flowing an aseptic gas through the conveying recess sufficiently to remove germicide from the conveying recess and to separate the atmosphere of the preceding step from the atmosphere of the succeeding step;

(6) further rotating said partition such as to move the conveyed container to the exit opening; and (7) moving said conveyed container from the conveying recess and into a succeeding step of the process.

2. The method of claim 1 wherein the germicidal gas is a gas containing a liquid germicide and residual germicide in the conveying recess is removed by using hot air as the aseptic gas.

3. The method of claim 2 wherein the germicide of the germicidal gas is hydrogen peroxide.

4. The method of claim 1 wherein the said rotatable partition and the said member are in a substantially gas tight relationship at least at the entrance opening and the exit opening and the aseptic gas is flowed into the conveying recess and from the conveying recess through openings therefor.

5. The method of claim 1 wherein, in the preceding germicidal step, a mist of a liquid germicide is flowed onto the container for sterilization thereof, in a succeeding step the liquid germicide remaining in and on the containers is removed from the containers by drying the containers, and wherein in both the said preceding germicidal step and the succeeding drying step the containers are held in and moved through those steps by comb-toothed conveyor arms, and wherein the arm is moved to perform a box-like motion by the arms moving laterally forwardly from a starting position, laterally sidewardly toward said partition, laterally backwardly so as to insert a container in a recess of a partition and laterally sidewardly to the starting position of the arm.

6. The method of claim 5 wherein at least one floor of an enclosure for the preceding germicidal step and at least one floor of an enclosure for the succeeding drying step are heated so as to prevent condensation of the germicide on areas of the enclosures which contact the containers.

7. The method of claim 6 wherein at least the arm in the germicidal step is heated so as to prevent condensation of the germicide on areas of the arm in contact with the containers.

* * * * *